US006394015B1

(12) United States Patent
Gabriel

(10) Patent No.: US 6,394,015 B1
(45) Date of Patent: May 28, 2002

(54) BOAT COLLISION AVOIDANCE SYSTEM USING BLASTS OF WATER

(76) Inventor: Edwin Zenith Gabriel, 91 Mt. Tabor Way, Ocean Grove, NJ (US) 07756

( * ) Notice: Subject to any disclaimer, the term of this patent is extended or adjusted under 35 U.S.C. 154(b) by 0 days.

(21) Appl. No.: 09/731,647

(22) Filed: Dec. 8, 2000

(51) Int. Cl.[7] ..... B63H 25/46
(52) U.S. Cl. ..... 114/151
(58) Field of Search ..... 440/38, 39; 114/151, 114/219; 340/984

(56) References Cited

U.S. PATENT DOCUMENTS

| | | | | | |
|---|---|---|---|---|---|
| 2,764,954 | A | * | 10/1956 | Oeltgen | 440/38 |
| 4,265,192 | A | * | 5/1981 | Dunn | 114/151 |
| 4,290,043 | A | * | 9/1981 | Kaplan | 340/984 |
| 5,029,546 | A | * | 7/1991 | Olson | 114/151 |
| 6,024,038 | A | * | 2/2000 | Kiliz et al. | 114/151 |

* cited by examiner

*Primary Examiner*—Ed Swinehart

(57) ABSTRACT

This application describes a technique for reducing or preventing the impact force between two small boats or between a small boat and a large boat about to collide. The technique involves the blast of high pressure water from one of the boats against the other to push it aside. The water blasts would be directed against the hull of the threatening boat. A distance sensor can automatically initiate the water blasts by sensing the closeness between the two boats. For manual operation of the water blasts, a switch can be closed at any time that one so wishes, to avoid the collision. One or more adjustable nozzles on water outlets, operated remotely in different directions, enable the boat's pilot to direct the blasts where they would be most effective in averting a collision. Thus, the three options for the boat's captain are: 1. Manually switching on motor-driven pumps to blast water out of fixed nozzles, 2. remotely, angularly positioning nozzles from side to side or up and down, 3. automatic operation by allowing distance sensors to determine when to blast water against the hull of a threatening boat.

11 Claims, 6 Drawing Sheets

FIG. 9
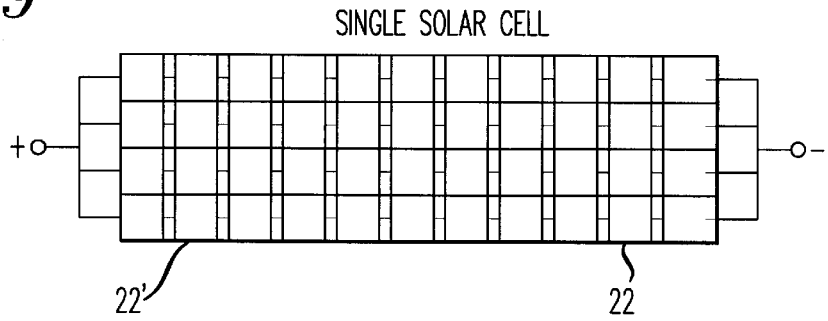
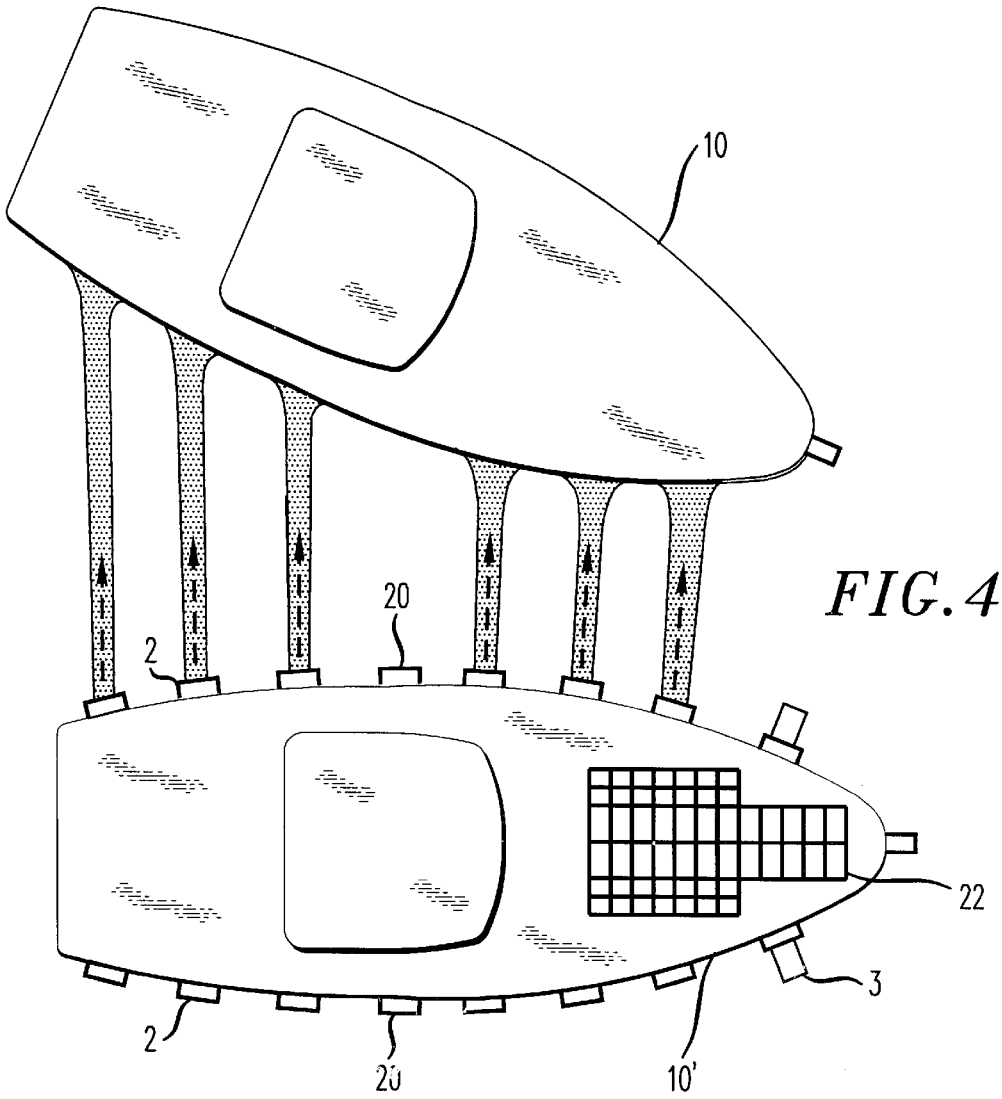
FIG. 4

WATER IN
PUMP
8
ELECTRIC MOTOR
9
P
5'
WATER IN
8
9
P
5'
VOLTAGE SOURCE
12'
12
AC
OR DC
DC
RELAY DPST
11
AC OR DC

27
REMOTELY ADJUSTABLE NOZZLES
VOLTAGE AMPLIFIER 15
POWER AMPLIFIER 16
MOTOR 17
GEAR TRAIN 18
E1
14
13
-Ef
3'
3'
3
14

BEVEL GEARS
MOTOR 17
GEAR 18
19
19'
DC OR AC
M
G
SIDE TO SIDE MOTION
3
PLAN VIEW

DC OR AC
M
G
19
19'
17
18
SIDE VIEW
SIDE TO SIDE MOTION
3

DC OR AC
M
G
19
19'
17
18
PLAN VIEW
UP AND DOWN MOTION

BOAT COLLISION AVOIDANCE SYSTEM USING BLASTS OF WATER

CROSS-REFERENCES TO RELATED APPLICATIONS

This is not a continuation-in-part of a previous application, nor one that is co-pending.

Rights of Inventions made under Federally-Sponsored Research and Development.

None of the work on this invention was performed under any Federally-Sponsored or State-Sponsored research and Development. Gabriel used his own resources on every phase of his project.

BACKGROUND OF THE INVENTION

The applicant is not aware of any patents pending or issued on his method of protection against impacts between two boats. He is aware of his own invention involving collisions between two autos. His pending patent uses high pressure air blasts to minimize the amount of damage between colliding autos. Other inventors use airbag crash protection as in U.S. Pat. Nos. 5,033,569, dated, Jul. 23, 1991, 6,031,449, dated Feb. 29, 2000, and 6,106,038, dated Aug. 22, 2000. In the present method, blasts of high pressure sea water against an incoming threatening small boat pushes the boat aside, so a collision does not occur.

SUMMARY OF THE INVENTION

The aim of this invention is a method of protection against impacts between two small boats or between a small boat and a larger one, by means of high pressure water blasts, from at least one of the boats having the protection system installed. If both boats have the protection system, then the collision avoidance would be more effective in averting an impact. The water blasts would be directed against the hull of the threatening boat. A distance sensor could automatically initiate the water blasts, by sensing the closeness between the two boats in open water or sea. One could adjust the distances between the boats from say 6 feet to 15 feet, for automatic operation. For manual operation of the system, one could judge when to turn on the system to avoid a collision. Experiments in the field and using computer simulation would determine the optimum distance, for boats of specified weights, and the amount of bursts and discharge of water needed to avoid a collision. The collision could be anticipated by the closing speed of the approaching boats. The higher the closing speed, the sooner in terms of distance should the system be activated to avoid a collision. Adjustable nozzles are provided which can be remotely moved up or down or sideways to assure that the water blasts strike the threatening object, including another boat.

The present invention concerns the use of high pressure water blasts to avoid collision between two small boats or collision between a small boat and a large one. The number and amount of blasts of water against the hull of another boat to prevent a collision depend upon the size and weight of the smaller boat. The smaller the boat, the easier to push it aside by blasts of water. It would be preferred to have the larger boat do the water blasting because it would be more capable of carrying the added weight of the water pumps and motors.

BRIEF DESCRIPTION OF THE DRAWINGS

For the purpose of illustrating the collision avoidance capability of the system to avert small boat collisions, the following drawings show forms which are presently preferred. It is to be understood that this invention is not necessarily limited to the precise arrangement, instrumentalities and field of utility as therein demonstrated.

FIG. 4 is a picture of two boats about to collide, one boat spouting water at other boat.

FIG. 9 is a top view of a solar panel with solar cells connected in series/parallel for adequate voltage and current supply,

DESCRIPTION OF A PREFERRED EMBODIMENT OF THE INVENTION

Figure 1:
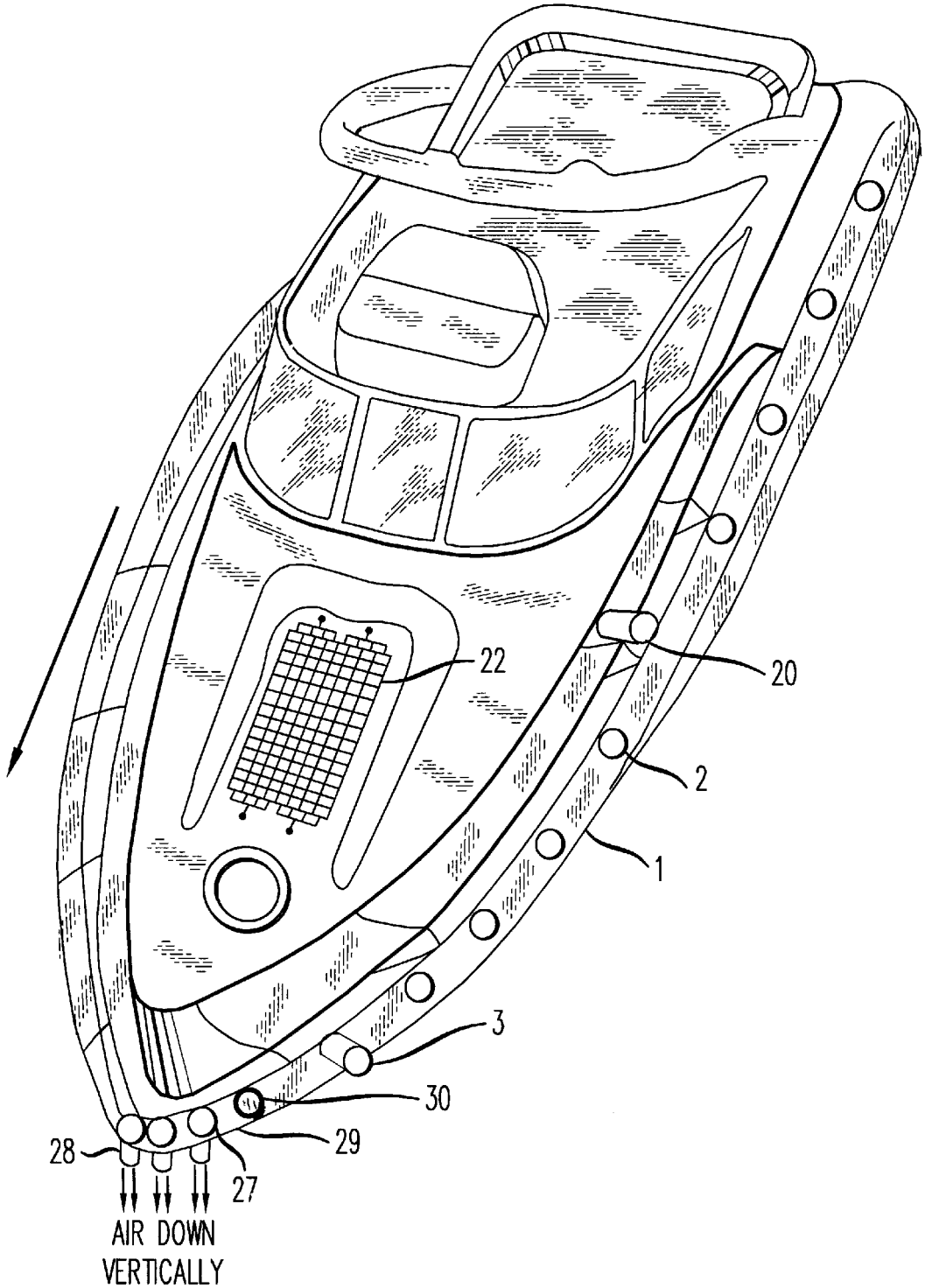
FIG. 1 is a picture of a boat showing the water nozzles just above its water line.
Figure 2:
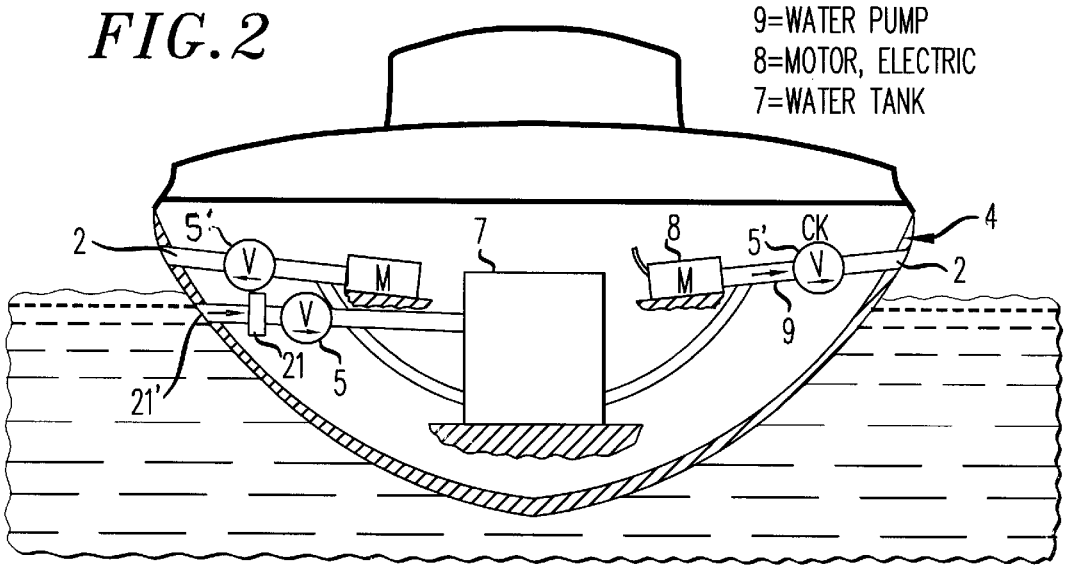
FIG. 2 is a cross section of the boat's hull showing the location of the pump(s), motor(s) and water tank, if any, diagrammatically, including the inlets and outlets of the system for boat collision avoidance.
Figure 3:
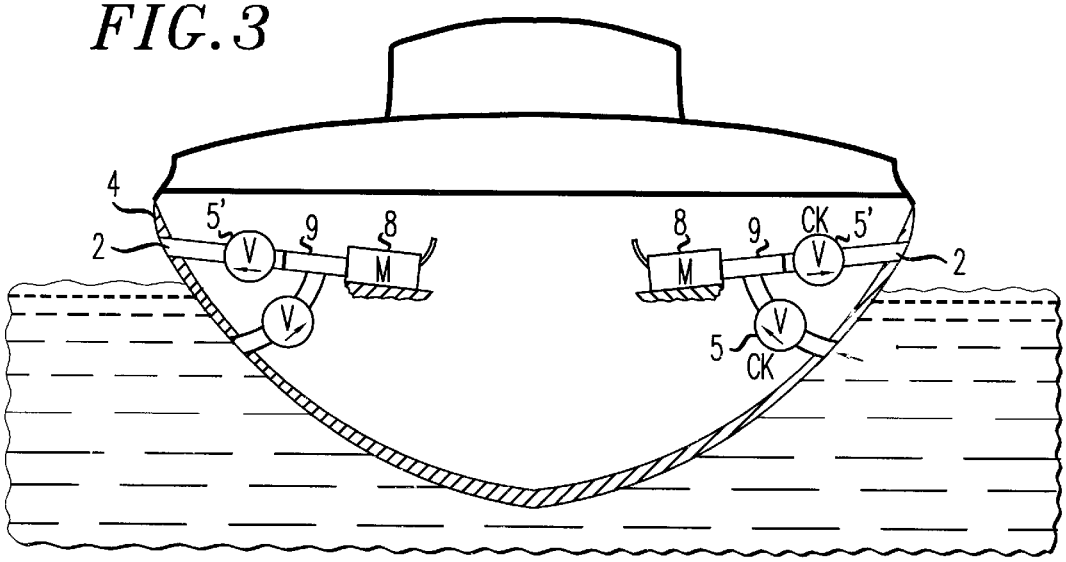
FIG. 3 is another cross section of the boat's hull showing the location of the pump(s), motor(s) and value(s) or outlet (s). The pumps could be force pumps, or other types of pumps able to deliver the amount of water at the desired pressure in psi, so the water sprouted would travel and reach the distance needed to stop or slow down an impending collision.

In this preferred embodiment high pressure, high volume sea water is used to avoid collision of small boats or a small boat with a larger one. FIG. 1 shows a top, side view of a motor boat 1 fitted with water outlets 2, angularity variable water outlet nozzle 3 and distance sensor 20. More or outlet ports water outlets or outlet ports 2 are shown than may be need to push aside a boat threatening to collide with boat 1. Although a motor boat is shown, the boat could be a sail boat and the or outlet ports locations of the outlets or outlet ports 2, 3 and sensor 20 could be, as shown, on its hull above the water line. The outlets 2 and 3 would have check valves to prevent water from entering the boat in rough sea. Boat 1 would have a similar arrangement of outlets and distance sensor 20 on both sides of the boat, as shown in FIGS. 2, 3 and 4, so that no matter which ever side the threatening boat approached, boat 1 could respond with high pressure water blasts, the amount and pressure of water would be determined from calculations, computer simulation and experimentation. The initial experiment would be performed in slow motion, so as not to risk damaging collisions of the selected boats. Inlet ports 2 are in fluid communication with a selected supply of water.

The pump 9 with motor 8 can be purchased as an integral coupled pump-motor unit from Hale pumps or "Teel", made of stainless steel to withstand the corrosive effects of salt sea water. One would determine the pump's outlet pressure and the GPM needed to be pumped, then read the manufacturer's chart for the model and stock number most suited and satisfying one's specification. For fresh water application the less expensive cast-iron pump housings may be used.

FIGS. 2 and 3 show two configurations for the pump systems. FIG. 2 shows the pump motor combination with a water tank 7. The tank fills up by gravity, then when needed, the pumps, which could be self-priming would suck up water from the tank to blast out through outlets or apertures 2. The water entering the tank 7, would be filtered by a screen to keep out small fish and algae and other undesirable small objects, including weeds, to prevent the pump from becoming clogged. A screen also would be desirable at the inlets to pumps 9, FIG. 3. Although only two pump/motor units are shown in FIGS. 2 and 3, they are typical of other such pump/motor combinations stacked against the hull. Check valves 5 and 5' at outlets and inlets, prevent water flowing in the reverse direction. Although the inlet piping is shown entering from underneath the pump, the piping could enter at the side of the pump, thus requiring less suction pressure.

Figure 5:
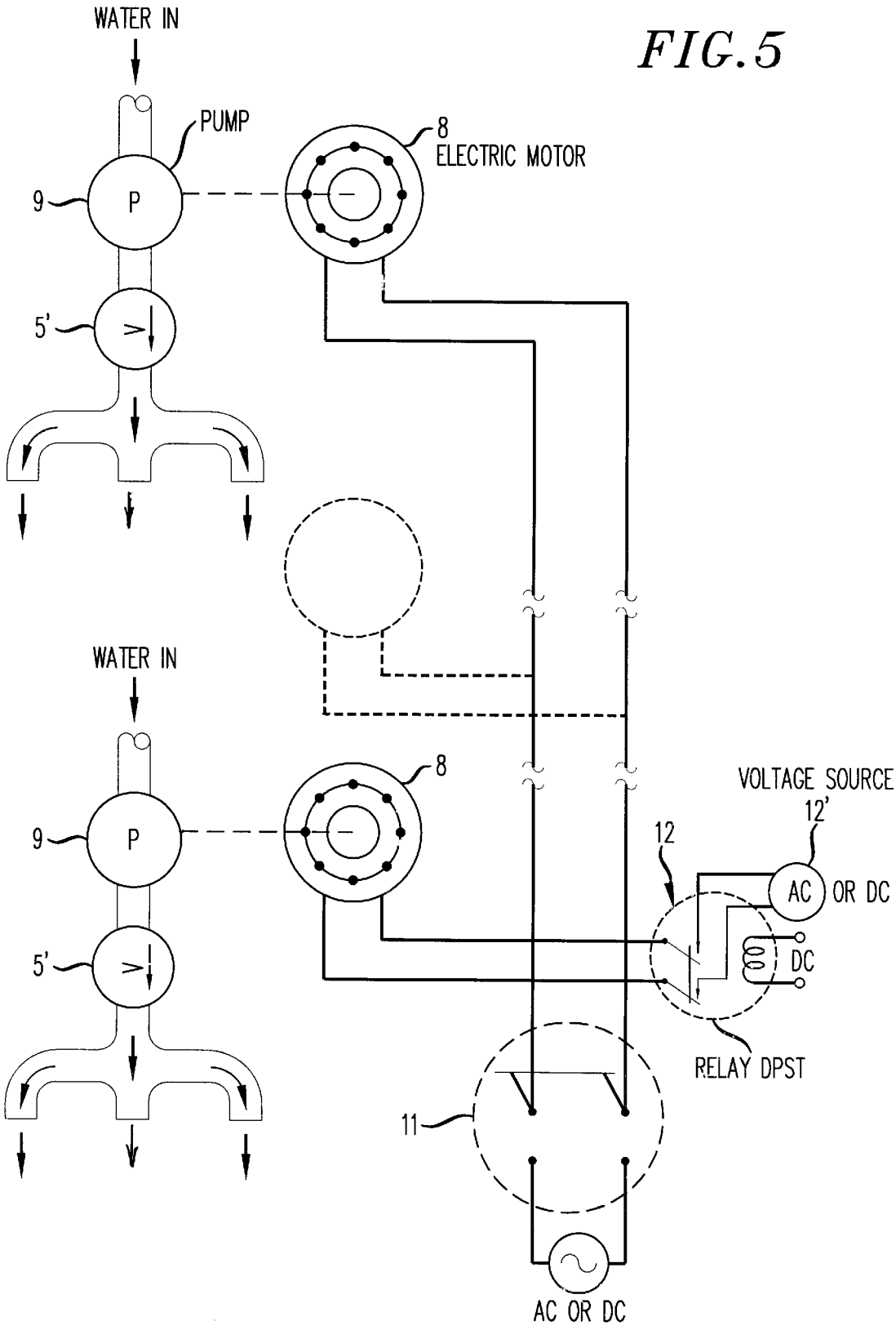
FIG. 5 is an electrical schematic of pumps and induction motors, including a switch and relay.

FIG. 4 shows two small boats 10 and 10' about to collide. The threatening boat 10 is pushed aside by blasts of sea water from boat 10', to avoid the occurrence of a collision. Distance sensor 20, FIG. 7, when activated by closing switch 25, FIG. 7, enables sensor to close relay 12, FIG. 5, and cause pump motors 8 to operate and cause the pumps to blast water from outlets 2, FIGS. 2 and 3, against the other menacing boat. There would be two circuits like the one shown in FIG. 5, one for each side of the boat, as well as two distance sensors 20, FIG. 7. Relay 12 can be by-passed by DPST Switch 11, should the boat's captain and pilot decide to activate the pumps sooner to avoid a collision. The action of the high pressure, high volume water spurting from pump outlets 2, would have two effects, pushing the menacing boat out of the water and causing boat 10', FIG. 4, to recoil from the reactions of the blasting water from outlets 2.

In FIG. 1, outlet nozzle 3 is remotely adjustable so the roaring, bursting water from the nozzle would slam at the proper location of the menacing boat, so as to push it aside.

Figure 6:
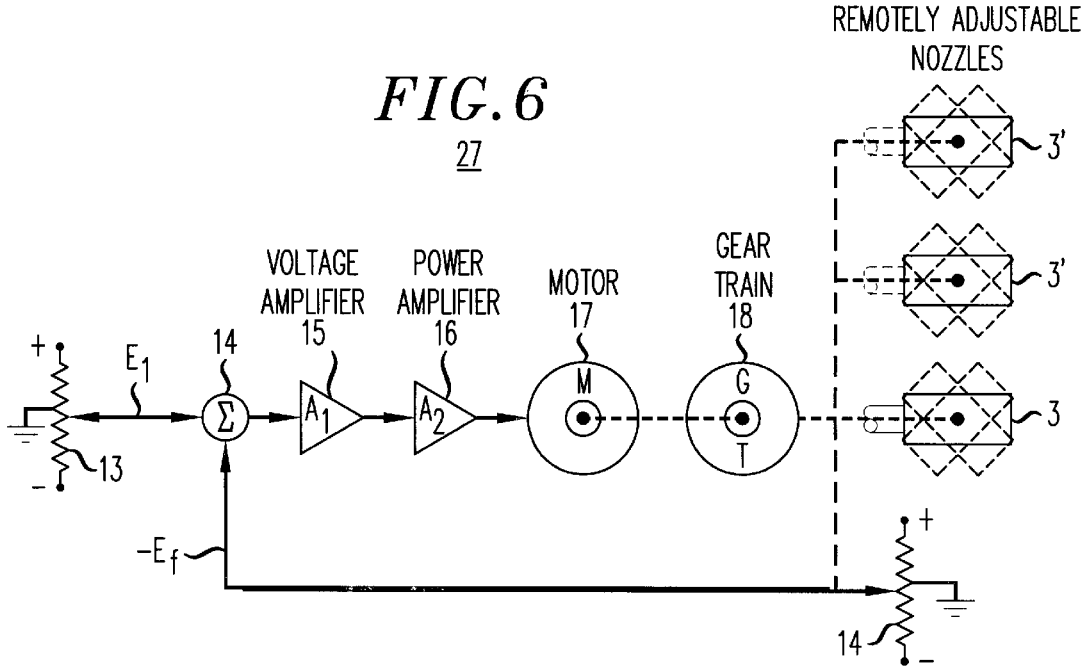
FIG. 6 is a wiring schematic of remotely-controlled activated water nozzles to position them vertically in order to focus the discharge of high pressure $H_2O$ on the other boat's hull.
Figure 6A:
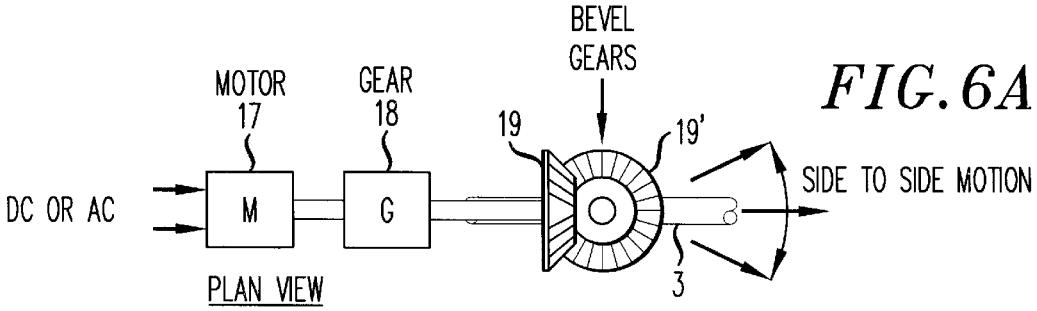
FIG. 6A is a top view of a mechanical diagram, showing how the water outlet nozzle could be directed up or down, or sideways, depending how the mechanical parts are oriented.
Figure 6B:
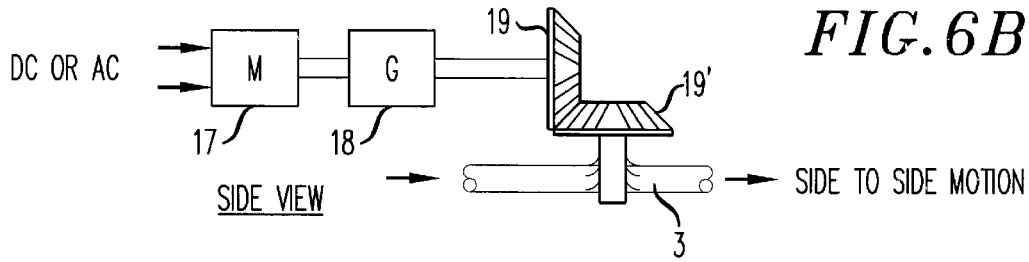
FIG. 6B is a side view thereof.

FIG. 6 shows the circuit for accomplishing the remote operated angular movement of outlet nozzle 3, either up and down or sideways, by adjustment of potentiometer knob 13, FIG. 6. To explain the circuit's operation, the position-control servomechanism 27 has an input bi-polar positioning potentiometer 13, whose output voltage $E_1$ is applied to summing network 14. The summer's output, the error signal, is applied to a voltage amplifier 15. Then, the amplified signal is applied to a power amplifier 16, whose output has sufficient energy to drive a dc motor 17; the motor's shaft speed is appreciably reduced by a gear train 18. Its output drives both a potentiometer 14, identical to input potentiometer 13, and bevel gears 19 and 19', FIGS. 6A and 6B. The bevel gears cause nozzle 3 to turn in the direction to directly face the menacing boat and blast high pressure water on the incoming boat 10, to push it away. This same servo system would direct other outlet hoses 3' also in the desired direction of the menacing boat 10, to avert a collision, as shown in FIG. 6. FIGS. 6A and 6B show the top and side views, respectively, of the mechanical gearing for implementing the hose's desired motions. In this particular arrangement of bevel gears, hose 3 moves sideways. In another similar arrangement hose 3 could be moved up and down to arrive at the right angle of water blast at the menacing boat, as in FIG. 6C.

Figure 6C:
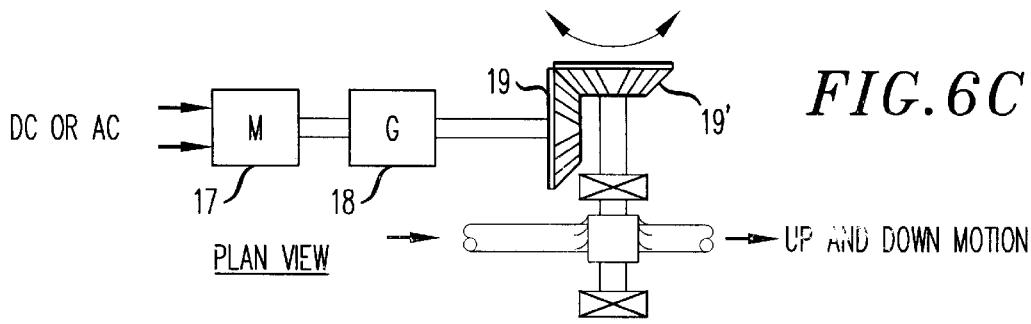
FIG. 6C is a top view of a mechanical gearing system showing the water outlet nozzle able to be angularly moved up and down.

In FIGS. 6A, 6B and 6C, motor 17 could be either an AC or a DC motor, depending upon what voltages and frequencies are available in the boat. Motor 17 is coupled to gear reducer 18, FIG. 6A, whose output shaft has a bevel gear attached to its end. Bevel gear 19 is meshed with another mating bevel gear 19'. Depending on its orientation with respect to bevel gear 19, hose 3 moves sideways as in FIG. 6A or up and down as in plan view, FIG. 6C, to help move the menacing boat aside; depending upon the boat's shape above the water line, the operator of the collision avoidance system would want to direct the blast of water either up and down or from side to side.

Figure 7:
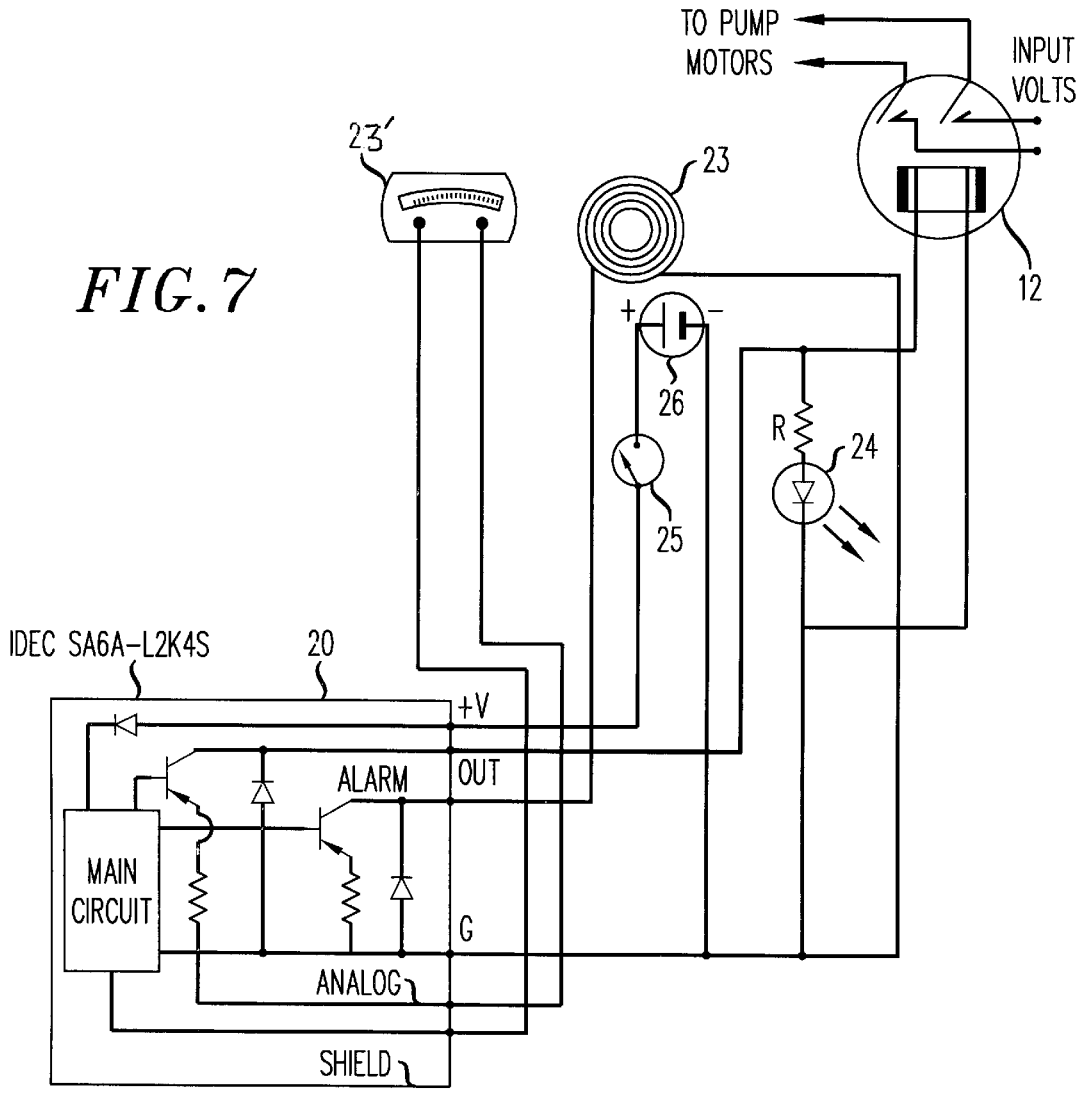
FIG. 7 is a diagram of a IDEC distance sensor system using ultrasonic sound waves, to sense an object, showing essentially a block diagram of the sensor having its electrical output applied to a distance meter, an alarm and a DPST relay, for energizing the pump motors.
Figure 8:
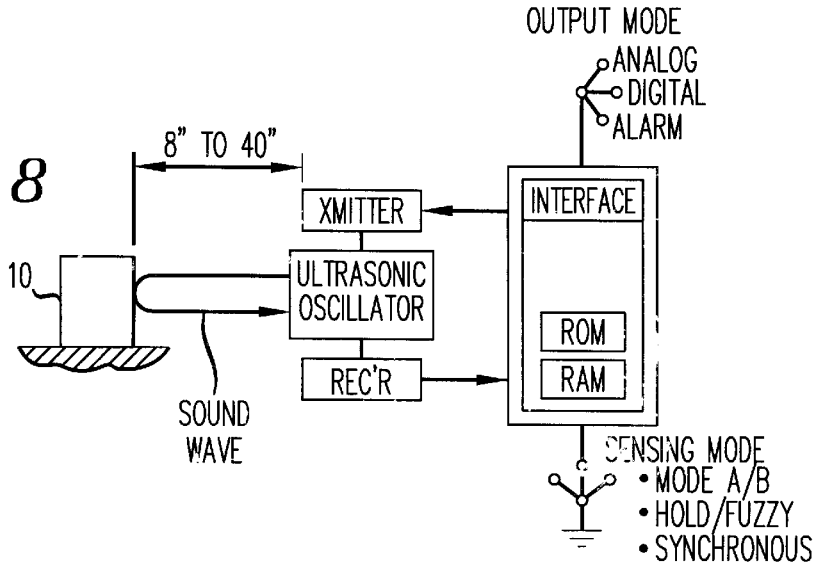
FIG. 8 shows another essentially a block diagram of the sensor with its sound wave output reflecting against an object.

Ultrasonic distance sensor diagram, FIGS. 7 and 8, provide power to pump motors 8 automatically when the sensor's distance from the object occurs. Power is applied to the motor circuit, FIG. 5, by the closing of relay 12, when the sensor of FIG. 7 detects a fast moving object closing in on boat 10', FIG. 4. The SA6A ultrasonic analog distance sensor is an off-the-shelf sensor manufactured by IDEC Corp., Sunnyvale, Calif. 94089-2211. Alarm 23, FIG. 7, sounds with excessive temperature, when sensor head is dirty or when the reflected sound waves are insufficient to operate relay 12. Distance indicator 22, located in the ship captain's post, tells the captain how close his ship is to the menacing boat 10, FIG. 4. Manual switch 25, FIG. 7, turns on the ultrasonic sensor circuit.

The batteries on the first boat need to be kept charged at all times to supply the needed energy for operating the motor-driven pumps. To help the boat's batteries keep their charge, solar-cell panels 22 are mounted on the boat's exposed surface, where they would receive optimum sunlight during sunny days. The solar cells 22' are connected in series/parallel to provide the specified voltage and current needed to recharge the boat's batteries, as shown in FIG. 9. If the boat has a roof, the solar-cell panels could be mounted thereon, so as not to interfere with other items already present on the boat's deck surface. The solar-cell panels would be hermetically sealed to keep out rain and sea water that could interfere with their proper operation. A transparent plastic sealed cover would be a suggestion.

In FIG. 1 an elongated tubular bumper 29, has been added, playing a dual role. Bumper 29, made of springy stainless steel has air inlets 27 and air outlet ports 28. When the boat is travelling in the water, air enters at inlets 27 and discharged at outlets 28. The air velocity could be high when the boat is moving at, say, 60 mph. According to Newton's third law of motion, there is a reaction to every action and, thus, front-end bow boat buoyancy is provided by the air blast leaving potts 28. Elongated tube 29, located on the front-right side of boat 1 is repeated on the front-left side of the boat, The more ports, the more buoyancy provided, thus helping the boat to travel with less tesistance to the boat's forward movement. Collars at outlets 28 assist in helping the discharged air to flow vertically downward. Between inlet holes or apertures 27 are partitions, shown in dashed lines, to reduce turbulence and promote smooth air flow within bumper 29 from inlet to outlet ports. With less resistance to the boat's forward motion, engine fuel could be saved. Thus, bumper 29 provides a dual function of protecting the boat's bow while saving engine fuel.

Calculations for Water Velocity and Quantity for an Assumed Desired Force at the Nozzle of a Hose

| | | |
|---|---|---|
| Given: Nozzle or hose diameter, N | = | 2.5 inches |
| Water Density, P | = | 1000 kg/m$^3$ |
| | = | 0.95 gm/cm$^3$ at 0° C. |
| In English units, density, P | = | 1.843 slugs/ft$^3$ |
| FR = flow rate | = | slugs/ft$^3$ |
| Water Conversion factor | = | 7.48 gal./cu. ft. |

From page 77, "Physics" by Haliday and Resnick by John Wiley & Sons,

1. Force in Lbs.=M[slugs]×a [ft/sec$^2$]

Wanted: Velocity of water flowing out of nozzle for Force= 500 lbs.

From Eq. 1,

2. Force=ρpV$^2$A=ma=slugs×ft/sec$^2$ where A $$A = \frac{\pi d^2}{4} = \frac{6.25}{4} = 4.9 \text{ in}^2,$$

now converting to $$A=4.9(6.944\times10^{-3})\text{ft}^2=34.03\times10^{-3}\text{ft}^2$$

Substituting into Eg. 2:

3. F=500=1.843V$^2$34.03×10$^{-3}$

Solving for $$V^2 = \frac{500\times10^3}{1.843\times34.03} = 7.973\times10^3$$

Velocity=V=89.30 ft/sec $$\text{Volume} = \text{Velocity}\times A = 89.3\times34.03\times10^{-3}$$

$$= \underline{3.038 \text{ ft}^3/\text{sec.}}$$

Converting to gallons of water, V=3.038×7.48 gal/ft$^3$=22.7 gal/sec

In gallons/min, Vol/min=22.7×60=1364 gal/min $$\text{Pressure of water in Lbs/sq in} = \frac{500 \text{ Lb}}{4.9 \text{ in}^2} = 102 \text{ psi at hole outlet}$$

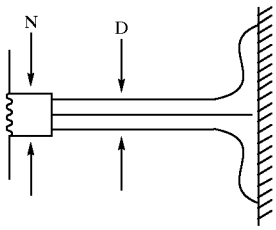

For condition when object is stationary and zero wind velocity

If the object is moving toward source of water blast, then the force of water impacting upon the object would be increased. As distance, L , is increased, the pressure per square inch of surface on object would be decreased, because with distance L the water blast's diameter would tend to increase. The greater the pressure, p, the less the water sprouted would increase in diameter. With wind blowing, depending up on its direction, the water sprouted out would further increase in diameter and in direction, being less effective in pushing aside another boat threatening to collide. The wind's velocity would be less effective by increasing the pressure of the water at the nozzle, N, say, increasing the pressure from 102 psi to 200 psi. The density of air would be a factor in decreasing the velocity of the flow of water. The hose diameter could be increased.

In regard to the water force selected above of 500 Lbs for each hose, one could select other magnitudes of force, depending on both the number of hoses on a boat's side and the size and weight of a second boat threatening the first boat with a collision. One would use the above same equations and mathematics for calculations of other forces, velocities and volumes of water.

I claim:

1. A boat-collision avoidance system, including a first boat having at least two sides, emersed in water, with selected sides being provided with motor-driven pumps, each motor driven pump having an inlet and an outlet port, each inlet port being in fluid communication with a selected supply of water, each outlet port being in fluid communication with apertures selectively positioned and spaced along the selected sides of the first boat, a motor control circuit for each selected side, having a manual mode of operation and an automatic mode of operation, each motor control circuit being electrically operated from at least one voltage supply, said first boat also having an eleongated tubular bumper at its bow with air inlet holes and outlet holes, said manual mode of operation including a manual switch, said automatic mode of operation including a control relay that is selectively energized to close said circuit, by at least one distance sensor, said distance sensor being selectively mounted on said first boat for sensing a second boat in close proximity thereto; and wherein when either said manual switch is closed or said control relay is energized, closed, all motor driven pumps in each motor control circuit associated therewith being activated for blasting high pressure water out of the selected side of said first boat to and towards the second boat threatening to collide with said first boat; the motor driven pumps being of sufficient capacity and number for providing high pressure water to offer the needed water force to push said second boat aside and avoid a collision between said first boat and said second boat.

2. A boat-collision avoidance system in accordance with claim 1, wherein said second boat having a hull and said distance sensor includes at least one ultrasonic distance sensor, emitting ultrasonic sound waves from an ultrasonic oscillator of said distance sensor, said sound waves when being reflected from the hull of said second boat, detecting the presence of said second boat and automatically closing said relay to activate and energize said motor-driven pumps to blast high pressure water against said second boat, then when said second boat being pushed a predetermined distance from said first boat, said pumps automatically stop pumping water, when said system being in said automatic mode of operation.

3. A boat-collision avoidance system in accordance with claim 1, wherein said system includes inlet ports and outlet ports, at least one water tank for water to enter into as a reservoir for said pumps to suck out water through said inlet ports and blast out high pressure water out of said outlet ports, said water tank needed when said surrounding water being polluted and muddy.

4. A boat-collision avoidance system in accordance with claim 1, wherein said inlet ports being provided with screens to prevent undesirable materials from entering said pumps and clogging their operation.

5. A boat-collision avoidance system in accordance with claim 1, wherein said motor-driven pumps being waterproofed and made of non-corrosive materials for long-lasting use.

6. A boat-collision avoidance system in accordance with claim 3, wherein at least one of said outlet ports of each of said sides of said first boat having a nozzle being remotely adjustable vertically, up and down, by a servomechanism, having an input and a feedback potentiometer, at least one voltage amplifier, a motor, mechanically attached to a speed reducer, whose mechanical output performing the adjustability of said nozzle.

7. A boat-collision avoidance system in accordance with claim 6, wherein said nozzle is adjustable horizontally from side to side to more effectively push said second boat aside.

8. A boat-collision avoidance system in accordance with claim 1, wherein said first boat having said pumps and each of said pumps having piping supplying high pressure water to more than one of said outlet ports, in order to reduce the number of pumps supplying water to said outlet ports.

9. A boat-collision avoidance system in accordance with claim 3, wherein said inlet port for entering said reservoir, including a filter for removing debris from the water in which said first boat being emersed.

10. A boat-collision avoidance system in accordance with claim 1, wherein said first boat having rechargeable batteries and solar cells installed on said first boat for recharging said batteries, said solar cells connected in series to provide a higher voltage and the series-connected cells connected in parallel to form solar panels to provide a higher current, needed to recharge said batteries, said batteries supplying the specified voltage and current for the motors of said motor-driven pumps, said solar panels being mounted selectively on the surface of said first boat to receive the optimum solar light during sunny days.

11. A boat-collision avoidance system in accordance with claim 1, wherein said inlet holes being oriented horizontally to receive high velocity air and said outlet holes oriented vertically downward to discharge said high velocity air, the discharged air helping to provide buoyancy to said first boat's bow, thus saving engine fuel, thereby said bumper serving a dual function, including protection to said first boat from a front-end collision with a second boat.

* * * * *